United States Patent [19]

Johnson

[11] 3,998,053

[45] Dec. 21, 1976

[54] THREE-PUMP - THREE-CIRCUIT FLUID SYSTEM OF A WORK VEHICLE HAVING CONTROLLED FLUID-COMBINING MEANS

[75] Inventor: Howard L. Johnson, Joliet, Ill.

[73] Assignee: Caterpillar Tractor Co., Peoria, Ill.

[22] Filed: Mar. 15, 1976

[21] Appl. No.: 667,227

[52] U.S. Cl. ..... 60/422; 60/428; 60/486

[51] Int. Cl.[2] ..... F15B 13/06; F15B 13/09

[58] Field of Search ..... 60/420, 421, 422, 428, 60/430, 445, 486, 444, 451, 452; 91/412; 417/286

[56] References Cited

UNITED STATES PATENTS 3,922,855 12/1975 Bridwell et al. ..... 60/421

*Primary Examiner*—Edgar W. Geoghegan
*Attorney, Agent, or Firm*—Frank L. Hart

[57] ABSTRACT

A fluid system of work elements of a work vehicle has first, second, and third fluid circuits each having a pump connected to a work element through a control valve assembly that is operated by a pilot pump. A fluid control means is provided for controllably combining fluid from each of the circuits with another one of the circuits.

12 Claims, 3 Drawing Figures

112
"S"
82
23
99
86
"S"
87
89
97
"S"
88
96
95
98
80
21
91
100
94
93
110
68
"M"
"P"
106
109
103
107
"P"
104
"G"
67
"K"
101
"H"
"J"
"G"
57
10
85
33
"P"
29
31
"B-B"
"I"
"E"
"E"
72
77
58
59
"B"
116
"I"
"A"
"B"
28
15
44
"A"
37
20
70
73
68
75
16
26
"G"
24
11
18
13
42

"S"
88
90
96
98
111
22
81
"P"
52
17
92
108
51
"P"
67'
105
"P"
68
50
49
102
"E"
"L"
83
"H"
"P"
47
"P"
48
"H"
67'
"P"
65
57
45
64
66
46
30
32
63
"B-B"
"N"
54
"O"
"D-D"
60
53
55
56
40
"Y"
"Z"
"X"
41
118
"R"
113
119
"Q"
"T"
120
39
62
61
35
114
122
"H"
115
36
37
38
34
"G"
121
116
"C"
"C"
"D"
"D"
117
37
69
71
74
76
"H"
25
27
43
12
19
14

THREE-PUMP - THREE-CIRCUIT FLUID SYSTEM OF A WORK VEHICLE HAVING CONTROLLED FLUID-COMBINING MEANS

BACKGROUND OF THE INVENTION

In order to reduce power requirements, materials and labor of a work vehicle having at least three fluid pumps each serving a fluid circuit, each having at least one work element, it is desirable to provide means for controllably combining fluid from each of the circuits with at least one of the other circuits.

This invention therefore resides in the apparatus for providing such a controlled fluid system as set forth above.

DETAILED DESCRIPTION OF THE INVENTION

Figure 1:
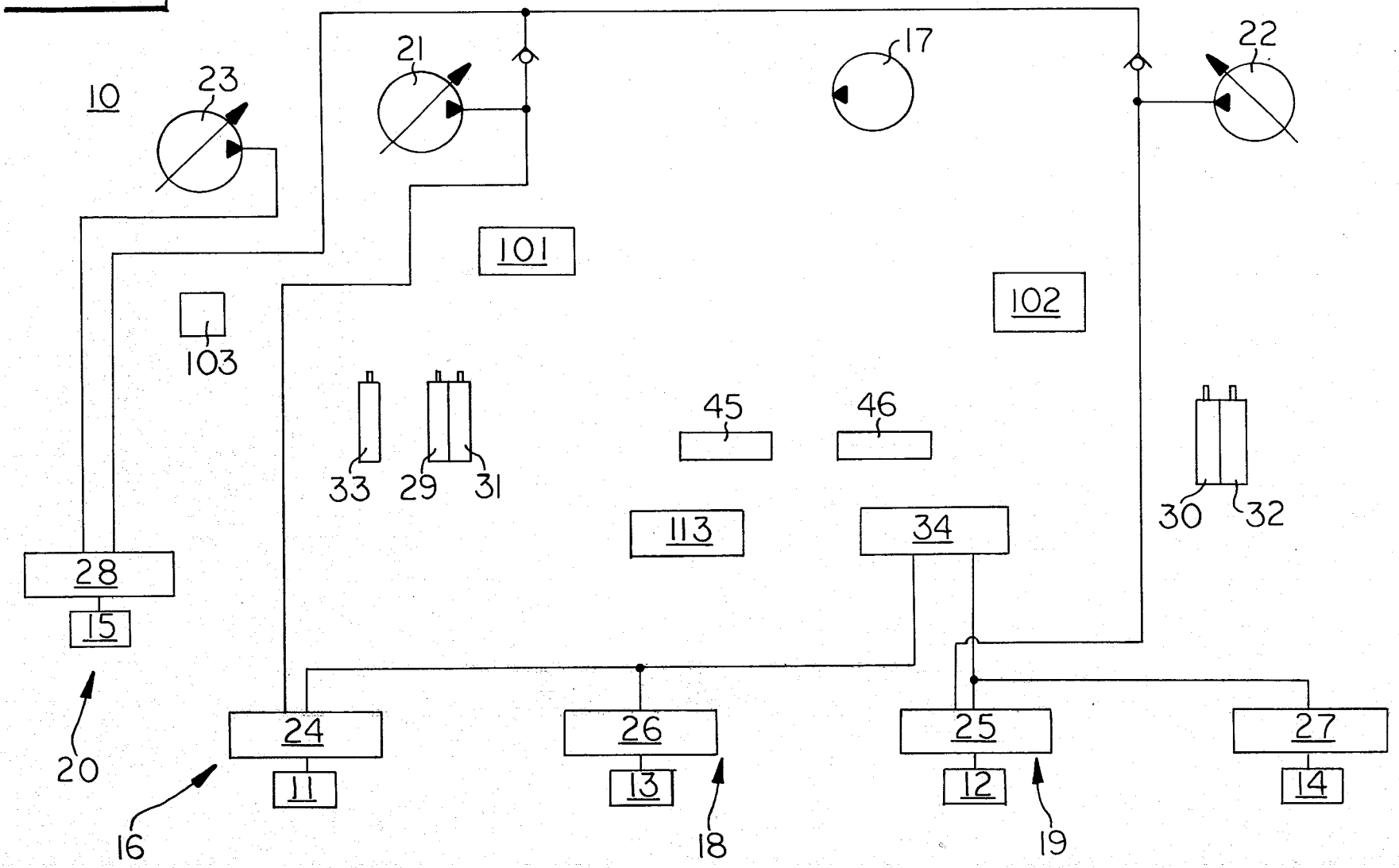
FIG. 1 is a general diagrammatic view of the fluid system of this invention.

Referring to the general view of FIG. 1, a work vehicle 10 has a plurality of work elements 11–15 operably connected to a fluid system 16, preferably a hydraulic fluid system, of the work vehicle 10. The work vehicle 10, for example an excavator, has a pilot pump 17 and at least first, second, and third fluid circuits 18,19,20, as better shown in FIGS. 2 and 3.

Figure 2:
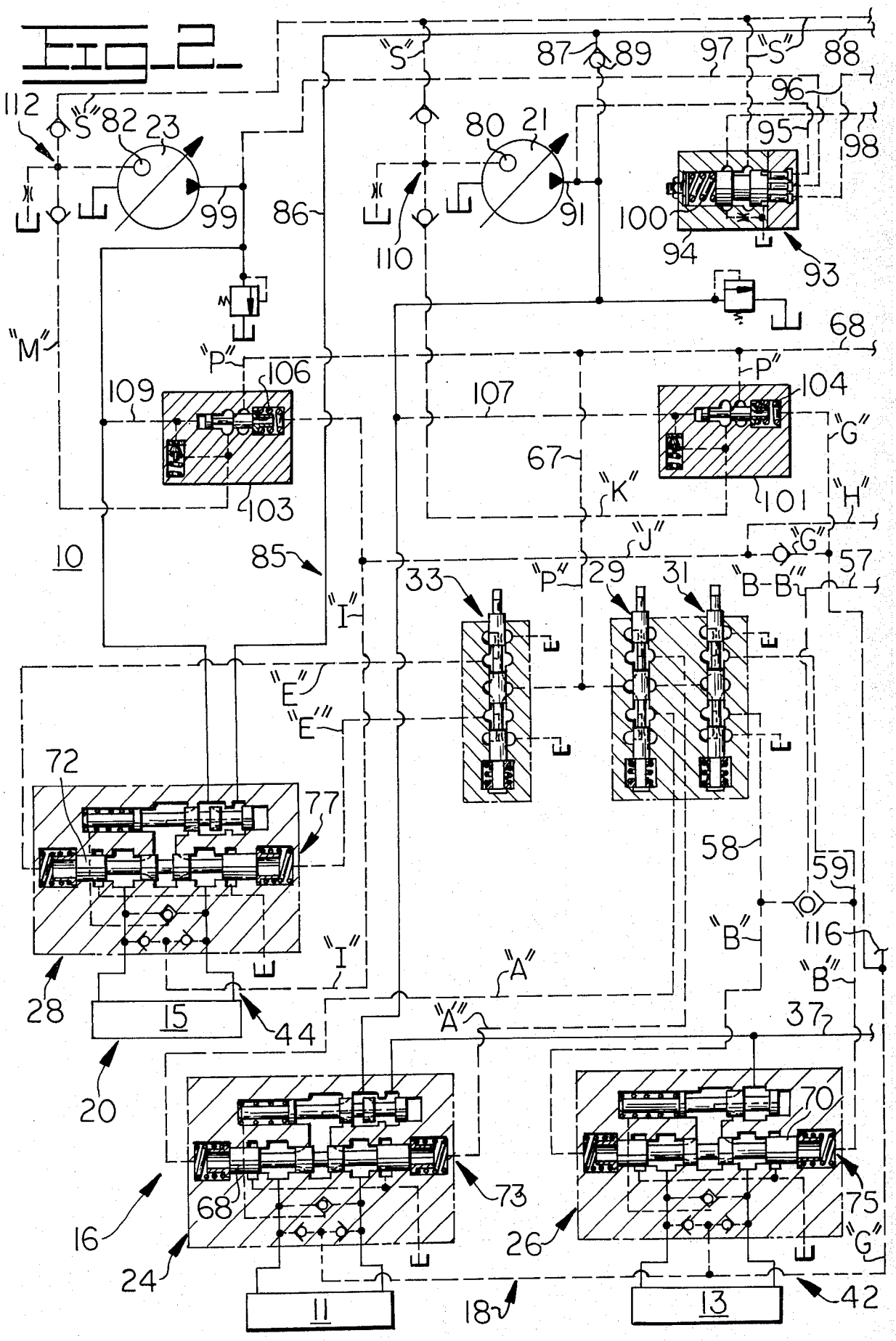
FIG. 2 is a more detailed diagrammatic view of a portion of the fluid system of FIG. 1.
Figure 3:
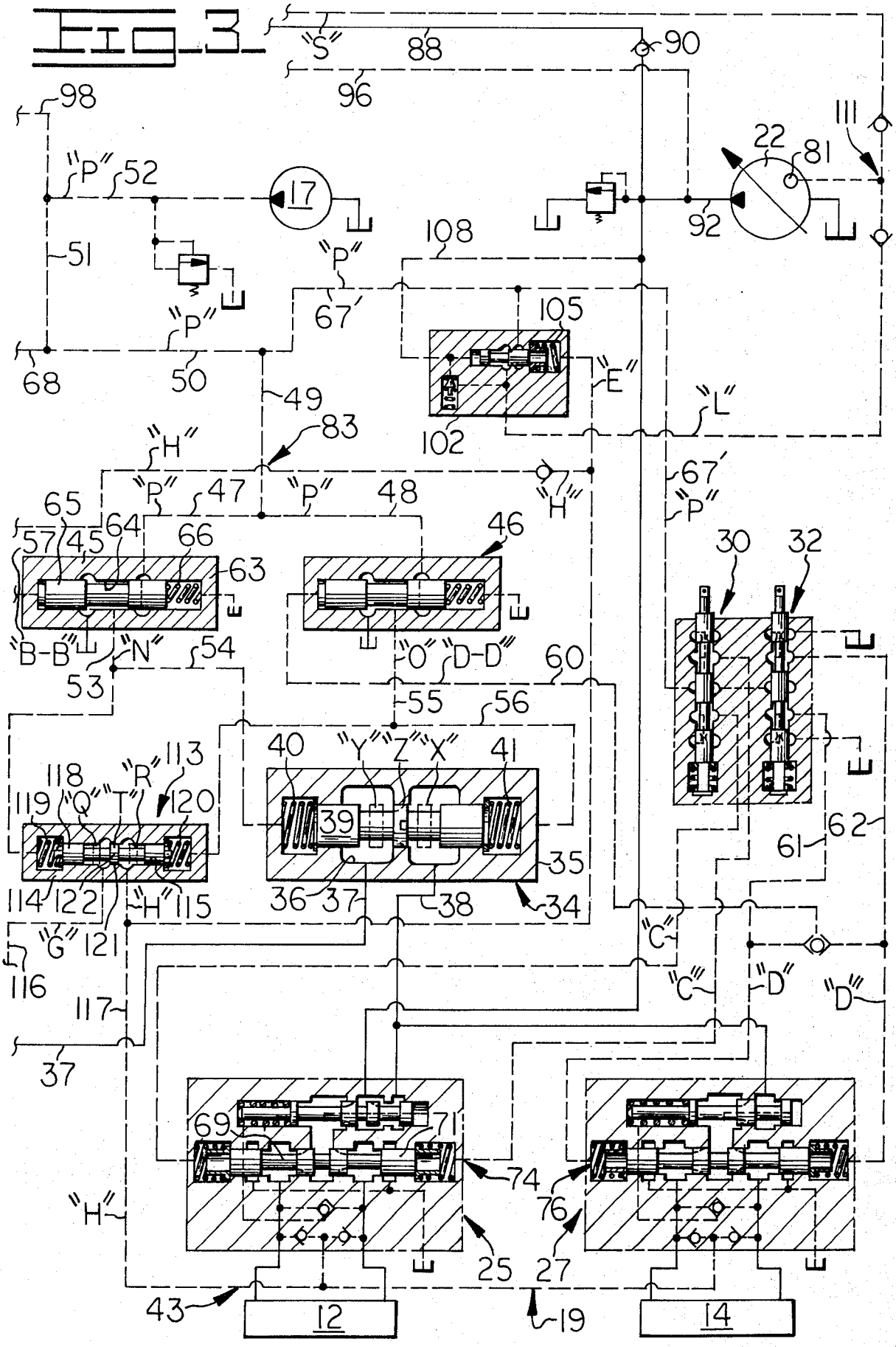
FIG. 3 is a more detailed diagrammatic view of the remaining portion of the fluid system of FIG. 1.

Referring to FIGS. 2 and 3, each fluid circuit 18,19,20 has a respective fluid pump 21,22,23 connected to one or more respective work elements 11–15 through a respective control valve assembly 24–28 for controlling the flow of fluid from the respective pump 21,22,23 to the respective work elements 11–15. Each fluid circuit 18,19,20 also has a primary pilot control valve 29–33 positioned between the pilot pump 17 and the respective control valve assembly 24–28 for altering a pilot pump signal P, delivering respective resultant signals A,A′, B,B′, C,C′, D,D′, E,E′, and controlling the operation of the respective control valve assembly 24–28 and associated work elements 11–15 in response thereto.

The fluid pumps 21,22,23 are variable displacement pumps having their outputs controllable in response to a received pressure signal, as is known in the art.

Fluid control means 34 is provided for controllably passing fluid between the first and second fluid circuits 18,19. The fluid control means 34 is responsive to preselected biasing forces and the resultant signals B-B′, D-D′ from downstream primary pilot control valves 31,32 of each first and second circuit 18,19. As hereinafter more fully described, each of the resultant signals B-B′, D-D′ is of a magnitude responsive to the position of the respective primary pilot control valve 31,32.

The fluid control means 34 has a housing 35 having a longitudinally extending chamber 36 that is in fluid communication with the first and second fluid circuits 18,19 via lines 37,38. A fluid control spool 39 is slidably positioned in the chamber 36 for movement between first and second positions X,Y shown by broken lines, at which the first and second fluid circuits 18,19 are in communication through the chamber 36, and an intermediate position Z, shown by solid lines, at which the fluid control spool 39 is preventing communication of the first and second circuits 18,19.

A pair of biasing elements 40,41 are positioned at opposed ends of the fluid control spool 39 for urging the spool 39 respectively toward first and second positions X,Y.

Each fluid circuit 18,19,20 has a signal means 42,43,44 for sensing the load pressure of each work element 11–15 of each circuit and delivering the respective control signals G,H,I that are each responsive to the greater load pressure of the work elements of its specific circuit.

Preferably, each of the signal means 42,43 of the first and second circuits 18,19 has a secondary pilot control valve 45,46 which is connected to the pilot pump 17 via lines 47–52. The secondary pilot control valves 45,46 are connected to the fluid control means housing 35 adjacent respective opposed ends, are in communication with the fluid control spool 39 via lines 53,54 and 55,56, and are further connected to a respective primary pilot control valve 31,32 via lines 57,58,59 and 60,61,62 for receiving resultant signals B-B′, D-D′.

The secondary pilot control valves 45,46 are preferably of common construction and only valve 45 will be described for purposes of brevity.

Each secondary pilot control valve 45,46 has a housing 63 having a chamber 64 in fluid communication with the pilot pump 17 and a respective end of the fluid control means housing 35. A spool 65 is movably positioned in the chamber 64 and has one end in fluid communication with the respective resultant signal B-B′. The spool 65 is movable through the chamber 64 between a first position, shown by broken lines, at which the pilot pump 17 and said respective end of the fluid control means spool 39 are in fluid communication and a second position, shown by solid lines, at which the spool 65 is preventing communication of the pilot pump 17 with said spool 39.

A biasing element 66 is provided for urging the spool 65 toward the second position in opposition to the respective resultant signal B-B′.

Each of the secondary pilot control valves alters a pilot signal P in response to its associated biasing force as opposed by its respective resultant signal B-B′ or D-D′, and delivers respective resultant signals N,O.

A preferred construction of the apparatus of this invention has each primary pilot control valve 29–33 connected to the pilot pump 17 via lines 51,52,67,68 and 50,51,52,67′ for receiving signals P. As is known in the art, each primary pilot control valve 29–33 alters a signal P and delivers respective pairs of control signals A,A′, B,B′, C,C′, D,D′, E,E′ to opposed ends of a respective spool 68–72 of a respective directional control valve 73–77 of control valve assemblies 24–28 for the controlled operation thereof. As set forth above, the respective resultant signals B-B′, D-D′ are each the larger of their associated pair of control signals B,B′, D,D′.

Each of the fluid pumps 21,22,23 has a respective pump control means 80,81,82 for controlling the output of the pump in response to a respective control signal G,H,I, as is known in the art. In the embodiment of this invention, a signal resolving means 83 is provided for sensing the control signals G,H of the first and second fluid circuits 18,19 and controlling the operation of the fluid pump 23 in response to the larger of said sensed signals, as indicated by J on the drawings.

Means 85, such as lines 86–88 and check valves 89,90, are connected to control valve assembly 28 and the respective discharge lines 91,92 of fluid pumps 21,22 for controllably passing fluid from the third pump 23 into at least one of the first and second circuits 18,19 in response to said resultant signal J.

Means 93, such as summing valve 94 and lines 95,96,97,98, is connected to the pilot pump 17 and the discharge lines 91,92,99 of each pump 21,22,23 for sensing the fluid discharge pressure of each fluid pump 21,22,23, controllably altering a pilot pump signal P in response thereto and delivering a resultant signal S to each pump control means 80,81,82 for controlling the operation of the pumps 21,22,23 in response thereto. The summing valve 94 functions to alter the pilot signal P to form signal S in response to the total fluid discharge pressure of the pumps 21,22,23 as opposed by a preselected biasing force imparted by biasing means 100.

A load margin valve means 101,102,103 is associated with each pump 21,22,23. Each load margin valve means 101,102,103 functions to alter a pilot pump signal P in response to a respective control signal G,H, and I or J, and deliver a respective resultant control signal K,L,M to its associated pump control means 80,81,82 for controlling the output of the respective pump 21,22,23. The load margin valve means 101,102,103 each alter a pilot pump signal P in response to the received respective control signal G,H, and I or J and a preselected biasing force, provided by respective biasing means 104,105,106, as opposed by the discharge pressure of the respective fluid pum 21,22,23. The respective pump discharge pressure is delivered to the respective load margin valve means 101,102,103, via respective lines 91,107; 92,108; and 99,109.

It should be noted that the control signal altering the pilot pump signals P by the load margin valve means 103 of the third circuit 20 can be signal I or signal J whichever is the larger of control signals G and H of the first and second circuits 18,19.

A resolver means 110,111,112 is associated with a respective pump control means 80,81,82 and is constructed for receiving the respective resultant control signal K,L,M from the respective load margin valve means 101,102,103 and resultant signal S, and passing the larger of said associated respective signals to the respective pump control means 80,81,82 for controlling the operation of the pump.

Therefore, under different operating conditions, the first pump 21 can be controlled in response to signals S or K, the second pump 22 can be controlled in response to signals S or L and the third pump 23 can be controlled in response to signals S or M. Further, it should be noted that the third pump 23 is responsive to the signal I of the third circuit 20 and signal J of the first and second circuits 18,19.

A signal crossover means 113 is connected to the signal means 42,43 of the first and second circuits 18,19 and to the first and second secondary pilot control valves 45,46. The signal crossover means 113 functions to controllably pass the first and second control signals G,H between the first and second circuits 18,19 in response to the first and second secondary pilot signals N,O.

The signal crossover means 113 has a housing 114 having a chamber 115 in fluid communication with the first and second control signals G,H passing through lines 116,117.

A spool 118 is movably positioned in chamber 115 for movement between first and second positions Q,R, shown by broken lines, at which signals G,H are in fluid communication through the chamber 115. At an intermediate position T, the first and second control signals G,H are free from fluid communication.

First and second biasing elements 119,120 are positioned at and bias opposed ends of the spool 118.

The chamber 115 preferably has an annular land 121 on the housing 114 and extending into the chamber 115. An annular flange 122 extends outwardly from the spool 118 and is mateable with the land 121 at the intermediate position T of the spool 118. First and second ports open into the chamber 115 on respective opposed sides of the land 121. The ports are in fluid communication with the housing chamber 115 and the respective first and second control signals G,H of lines 116,117.

In the operation of the apparatus of this invention, the work elements can be a left track 11, right track 12, boom 13, bucket 14, and swing motor 15. The fluid system 16 is constructed so that the fluid requirements of the swing motor 15 are met before any fluid is available for passing to the first and second circuits. The first and second circuits 18,19 are constructed so that the fluid requirements of the left and right tracks 11,12 are met before fluid is available through the respective first and second circuits to the more downstream work elements 13,14 of the respective circuits 18,19. This arrangement is commonly referred to as an interrupted series which indicates that work elements 11,12,15 are preferentially delivered fluid from their respective pumps 21,22,23.

Under fluid demand conditions of both the first and second circuits 18,19, the spool 39 of the fluid control means 34 will be at the intermediate position Z and the fluid from pumps 21,22 will not pass between the first and second circuits 18,19. However, where there is substantially no fluid demand by one circuit, the spool 39 will be urged toward its first or second position X,Y and fluid from the circuit requiring substantially no fluid will pass into the other fluid circuit and assist in supplying its fluid demands.

When additional fluid is needed by work elements of the first and/or second circuit 18,19 and the fluid demands of work element 15 are being met, fluid is delivered from the third pump 23 into the first and/or second circuits 18,19 via line 86,87,88.

The apparatus of this invention is further controlled by providing pump control signals S to all of the pumps and controlling the magnitude of this signal S in response to a summation of the discharge pressure of all the pumps 21,22,23. Other signal crossovers between the circuits 18,19,20 and signal modifications and alteration are apparent from a study of the drawings.

Therefore, the fluid system of this invention provides for controlled operation of a three fluid pump system where fluid priority is given to preselected work elements of the system and fluid of the various circuits is controllably combined in response to the fluid needs of the work elements.

Other aspects, objects, and advantages of this invention can be obtained from a study of the drawings, the disclosure, and the appended claims.

What is claimed is:

1. In a fluid system of work elements of a work vehicle having a pilot pump and first, second, and third fluid circuits, each fluid circuit having a fluid pump connected to a work element through a control valve assembly for controlling the flow of fluid from each pump to its respective work element and a primary pilot control valve positioned between the pilot pump and the control valve assembly for altering a pilot pump signal P and delivering resultant signals, the improvement comprising:

fluid control means for controllably passing fluid between the first and second fluid circuits in response to resultant signal from a pilot control valve of each first and second circuit;

signal means for sensing the load pressure of each respective circuit and delivering respective control signals;

pump control means for controlling the respective pumps in response to the respective control signals;

signal resolving means for sensing the control signals of the first and second circuits and controlling the operation of the third fluid pump in response to the larger of said sensed signals; and means for controllably passing fluid from the third fluid pump into at least one of the first and second circuits in response to said resultant signal.

2. A fluid system, as set forth in claim 1, wherein at least one of the first and second circuits has a plurality of work elements each having a respective control valve assembly and primary pilot control valve and said plurality of control valve assemblies of a circuit are connected in series.

3. A fluid system, as set forth in claim 2, including:

means for sensing the fluid discharge pressure of each fluid pump, controllably altering the pilot pump signal in response thereto, and delivering a resultant signal S to each pump control means for controlling the operation of the pumps in response thereto.

4. A fluid system, as set forth in claim 3, wherein the pilot signal is altered in response to the fluid discharge pressure of all fluid pumps as opposed by a preselected biasing force for forming resultant signal S.

5. A fluid system, as set forth in claim 3, including:

a load margin valve means associated with each fluid pump for altering a pilot pump signal in response to a respective control signal and delivering a resultant control signal to its associated pump control means for controlling the respective fluid pump.

6. A fluid system, as set forth in claim 5, wherein the pilot pump signal is altered in response to the respective control signal and a preselected biasing force as opposed by the discharge pressure of the respective fluid pump.

7. A fluid system, as set forth in claim 6, wherein the pilot pump signal is altered in response to the discharge pressure of the third fluid pump as opposed by a preselected biasing force and the larger of the control signals of the first, second, and third circuits.

8. A fluid system, as set forth in claim 7, including:

resolver means associated with each pump control means for receiving the respective resultant control signal and resultant signal S and passing the larger of said signals to the respective pump control means for controlling the operation of the respective fluid pump.

9. A fluid system, as set forth in claim 1, wherein the first and second circuits each have a plurality of serially connected work elements and associated control valve assemblies and primary pilot control valves for controlling the fluid control means for passing fluid between the first and second fluid circuits in response to the largest resultant signal of the most downstream primary pilot control valve of each first and second circuit.

10. A fluid system, as set forth in claim 9, including:

first and second secondary pilot control valve means each receiving a resultant signal from the respective primary pilot control valve and a pilot pump signal from the pilot pump for altering a respective pilot pump signal in response to the respective resultant signal as opposed by a preselected biasing force and delivering the resultant signals to the fluid control means for controlling the operation thereof.

11. A fluid system, as set forth in claim 10, including:

first and second secondary pilot control valve means each connected to the pilot pump, the fluid control means, and a respective primary pilot control valve for altering a pilot signal in response to the respective resultant signal as opposed by a preselected force and delivering resultant first and second secondary pilot signals to the fluid control means for controlling the operation thereof.

12. A fluid system, as set forth in claim 11, including:

signal crossover means connected to the signal means of the first and second circuits and to the first and second secondary pilot control valves for controllably passing the first and second control signals between the first and second circuits in response to the first and second secondary pilot signals.

* * * * *